US007802943B2

(12) United States Patent
Walker et al.

(10) Patent No.: US 7,802,943 B2
(45) Date of Patent: Sep. 28, 2010

(54) LOW PROFILE MINE ROOF SUPPORT

(75) Inventors: Roland Walker, Syracuse, UT (US); Alexander I. Wallstein, Laguna Beach, CA (US)

(73) Assignee: DSI Ground Support Inc.

( * ) Notice: Subject to any disclaimer, the term of this patent is extended or adjusted under 35 U.S.C. 154(b) by 379 days.

(21) Appl. No.: 11/972,367

(22) Filed: Jan. 10, 2008

(65) Prior Publication Data

US 2009/0180841 A1 Jul. 16, 2009

(51) Int. Cl.
*E21D 20/00* (2006.01)

(52) U.S. Cl. ..... 405/259.1; 405/302.2

(58) Field of Classification Search ..... 405/302.1, 405/302.2, 259.1, 259.4, 259.5, 259.6; 411/537
See application file for complete search history.

(56) References Cited

U.S. PATENT DOCUMENTS

| | | | | |
|---|---|---|---|---|
| 5,230,589 | A | 7/1993 | Gillespie | |
| 5,253,960 | A | 10/1993 | Scott | |
| 5,259,703 | A | 11/1993 | Gillespie | |
| 5,586,839 | A | 12/1996 | Gillespie | |
| 5,769,570 | A | 6/1998 | Stankus et al. | |
| 5,885,034 | A | 3/1999 | Fergusson | |
| 6,273,646 | B1 * | 8/2001 | Shaw | 405/259.1 |
| 6,322,290 | B1 | 11/2001 | Calandra, Jr. et al. | |
| 6,402,433 | B1 | 6/2002 | Gillespie | |
| 6,684,585 | B2 | 2/2004 | Campbell | |
| 6,881,015 | B2 | 4/2005 | Wallstein et al. | |
| 6,957,931 | B2 | 10/2005 | Slater | |
| 7,001,109 | B2 | 2/2006 | Mongrain | |
| 7,270,501 | B2 | 9/2007 | Kanflod et al. | |
| 7,381,013 | B1 * | 6/2008 | Rataj et al. | 405/259.5 |
| 2007/0036617 | A1 | 2/2007 | Oldsen et al. | |

FOREIGN PATENT DOCUMENTS

| | | |
|---|---|---|
| AU | 529082 | 2/1981 |

OTHER PUBLICATIONS

Office Action for U.S. Appl. No. 12/058,294, dated Apr. 2, 2009.

* cited by examiner

*Primary Examiner*—Sunil Singh
(74) *Attorney, Agent, or Firm*—Marshall, Gerstein & Borun LLP

(57) ABSTRACT

A low-profile mine roof support device comprises a roof plate and a barrel. The roof plate is generally flat and defines a through-bore. The barrel includes a head disposed at a first end, and a cylindrical body disposed at a second end. A tapered bore extends from the first end of the barrel toward the second end, and is for receiving a cable. At least one wedge is adapted to be received within the tapered bore of the barrel to anchor the cable thereto. The head of the barrel comprises a convex surface that seats against the plate such that a portion of the head penetrates the bore and intersects the first and second planes, thereby reducing the extent to which the support device extends into the mine without sacrificing the working length of the barrel.

24 Claims, 5 Drawing Sheets

LOW PROFILE MINE ROOF SUPPORT

FIELD OF THE INVENTION

The present invention relates generally to roof support devices used in underground mining operations and, more particularly, to low-profile roof support devices.

BACKGROUND

In mining operations, bolts are often used to support the roof of the mine. Typically, a bore is drilled into the rock formation that forms the mine roof, and then a mine roof bolt is placed in the bore and secured by a fast-curing resin material or other suitable substance. The roof bolt, which can be formed of wire strands woven or wound together to form a cable, includes a widened bearing plate that bears against a portion of the roof, thus holding a portion of the roof in place.

One approach for installing such bolts is to drill an oversized bore into the rock and then insert one or more resin cartridges into the bore. The elongated cable portion of the mine roof bolt is then forced into the bore, and rotated. This process ruptures the resin cartridges and mixes the two resin components together within the space between the cable portion of the bolt structure and the over-sized bore.

Such roof bolts typically include a wedge barrel. The wedge barrel provides a bearing surface so that the tensile load carried by the elongated cable bolt can be suitably transferred to the bearing plate. The wedge barrel is commonly joined to the cable bolt by a plurality of wedges which are wedged between the cable itself and an inside tapered surface of the wedge barrel prior to installation of the roof bolt. Using a suitable tool, the wedge barrel is spun to rotate the cable within the bore as mentioned above. So configured, the bearing plate and wedge barrel can intrude upon the working space within the mine because they extend below the mine roof.

SUMMARY

The present invention provides a low-profile mine roof support device. One embodiment of the device can include a plate comprising a bore, a first surface portion immediately surrounding the bore, a second surface portion immediately surrounding the bore, and a seating surface disposed between the second surface portion and the bore. The first surface portion can be entirely disposed within a first plane, and the second surface portion can be entirely disposed within a second plane that is parallel to the first plane. The first surface portion adapted to be abutted against a mine roof.

One embodiment of the device further comprises a barrel with a first end and a second end. A head is disposed at the first end of the bolt, and a body is disposed at the second end. A tapered bore extends from the first end toward the second end for receiving a cable. At least one wedge is adapted to be received within the tapered bore to anchor the cable to the barrel.

At least in one embodiment, the head of the barrel comprises a shoulder portion that includes a convex surface. The convex surface is in contact with the seating surface of the plate such that a portion of the head penetrates the bore of the plate and intersects the first and second planes.

DETAILED DESCRIPTION

The examples described herein are not intended to be exhaustive or to limit the scope of the invention to the precise form or forms disclosed. Rather, the following embodiments have been chosen to provide examples to those having ordinary skill in the art.

Figure 2:
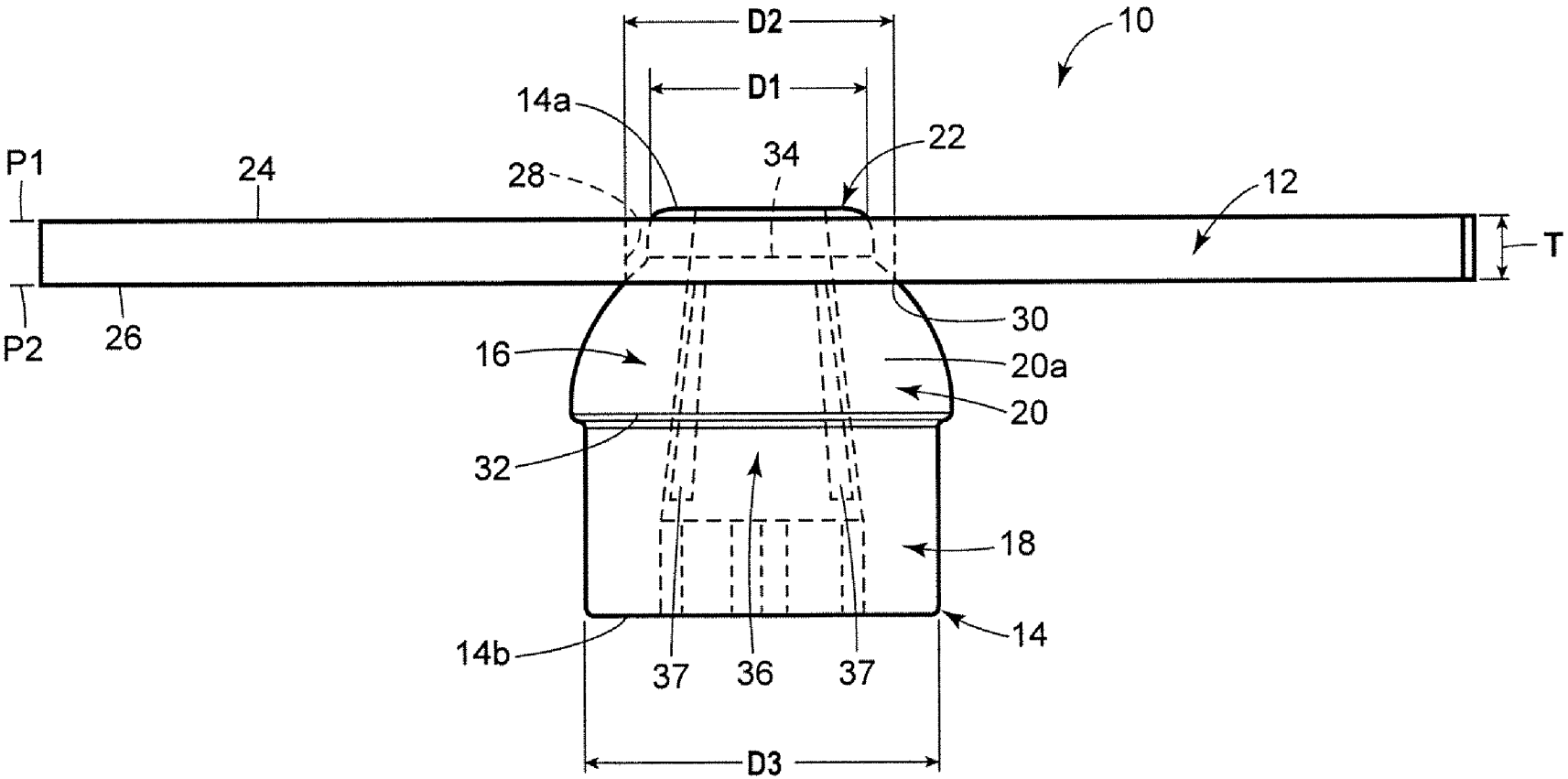
FIG. 2 is a side view of one embodiment of a mine roof support device constructed in accordance with the principles of the present invention and including the wedge barrel of FIG. 1 and a roof plate.

FIG. 2 depicts one embodiment of a low-profile mine roof support device 10 constructed in accordance with the present invention. Generally speaking, the support device 10 comprises a roof plate 12 and a wedge barrel 14, which is referred to hereinafter simply as a "barrel." As will be described, the barrel 14 includes a tapered bore 36 for receiving a cable 1 (shown schematically in FIG. 4) or other tensioning device that is suspended from a mine roof. The tapered bore 36 also receives a pair of wedges 37, as is known within the art, to secure the cable to the barrel 14. So configured, the roof plate 12 is adapted to engage the mine roof to provide support thereto.

Figure 1:
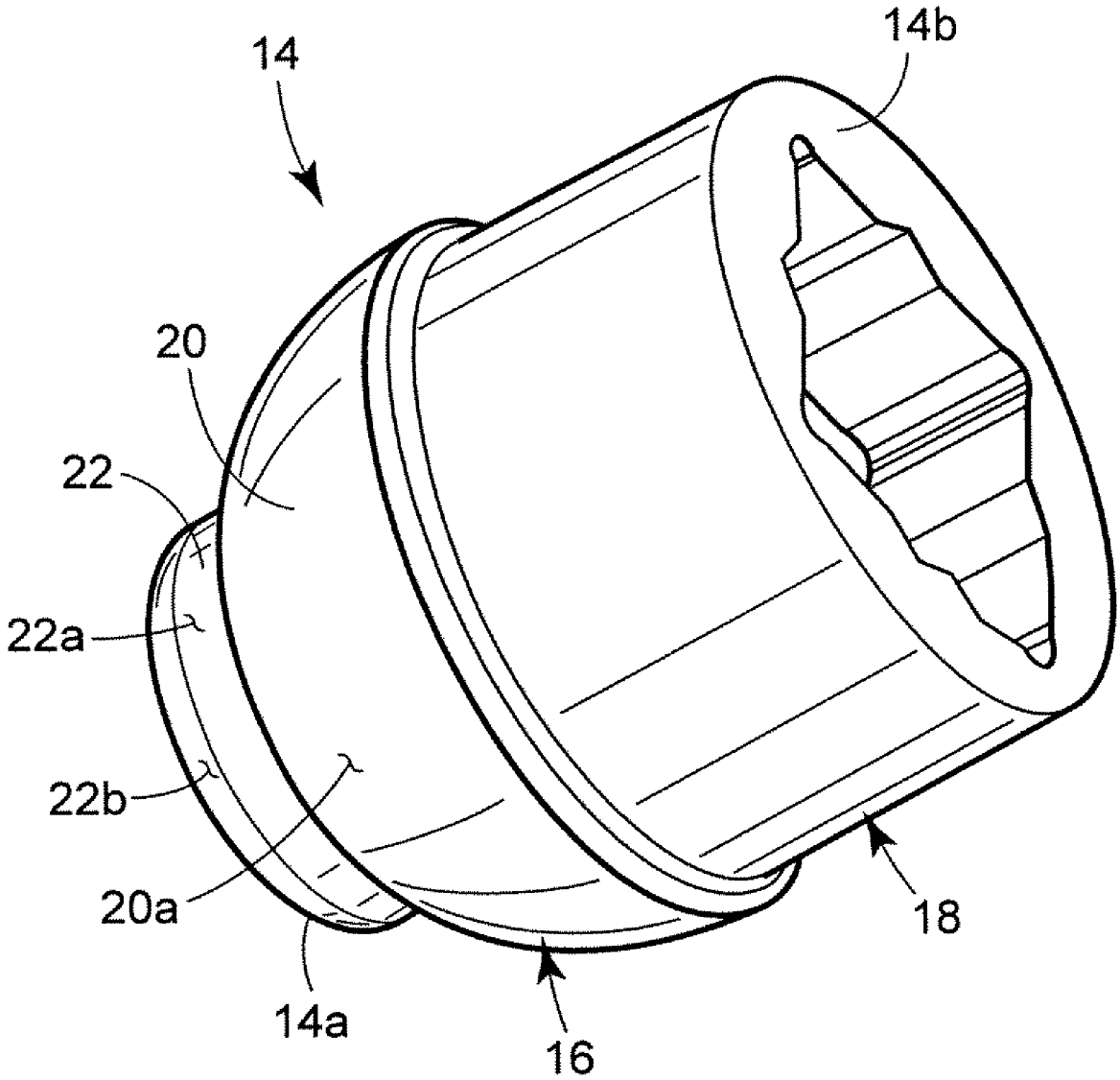
FIG. 1 is a perspective view of one embodiment of a wedge barrel of a mine roof support device constructed in accordance with the principles of the present invention.

Referring to FIG. 1, the barrel 14 comprises a first end 14*a* and a second end 14*b*. Additionally, the barrel 14 comprises a head portion 16 disposed at the first end 14*a* and a body portion 18 disposed at the second end 14*b*. In the disclosed embodiment, the body portion 18 comprises a generally cylindrical body, and preferably a generally right circular cylinder. The head portion 16 of the disclosed embodiment comprises a discontinuous side profile defined by a shoulder 20 and a nose 22. The shoulder 20 of the head portion 16 is disposed between the body portion 18 of the barrel 14 and the nose 22 of the head portion 16. Said another way, the shoulder 20 is spaced from the first end 14*a* toward the second end 14*b*, and spaced from the second end 14*b* toward the first end 14*a*. The shoulder 20 includes a convex external surface 20*a* that is adapted to seat against the roof plate 12, as illustrated in FIG. 2. The nose 22 extends from the shoulder 20 and terminates at the first end 14*a* of the barrel 14. The nose 22 includes a cylindrical nose defining a generally cylindrical external surface 22*a* (shown in FIG. 1) and a bull-nosed surface 22*b* (shown in FIG. 1). The bull-nosed surface 22*b* includes a radius R1 (shown in FIG. 4) that extends from the cylindrical external surface 22*a* to the first end 14*a* of the barrel 14. In one embodiment, the radius R1 of the bull-nosed surface 22*b* can be approximately 1.88" (4.77cm).

Still referring to FIG. 2, the roof plate 12 of the presently disclosed embodiment of the roof support device 10 includes a generally flat plate comprising a first surface 24, a second surface 26, and a through-bore 28. The first surface 24 is disposed within a first plane P1 at least in the region immediately surrounding the through-bore 28. The second surface 26 is disposed in a second plane P2 at least in the region immediately surrounding the through-bore 28. A "plane" is understood by one of ordinary skill in the art as a two-dimensional surface of infinite dimension and having generally zero curvature within suitable tolerances based on known manufacturing processes.

In the disclosed embodiment, the first plane P1 is parallel to the second plane P2 such that the first and second surfaces 24, 26 are parallel to each other at least in the region immediately surrounding the through-bore 28. The through-bore 28 includes a generally cylindrical bore extending between the first and second surfaces 24, 26 of the roof plate 12. Accordingly, the roof plate 12 defines a circular seating surface 30 at the interface between the second surface 26 and the through-bore 28. As illustrated, the shoulder 20 of the barrel 14 seats against the seating surface 30. In the disclosed embodiment, the external surface 20*a* comprises a partial spherical surface that follows a constant radius R2 (shown in FIG. 4) from a beginning end 32 to a terminal end 34. In one embodiment, the radius R2 of the shoulder 20 can be approximately 1.063" (2.7 cm).

Figure 3:
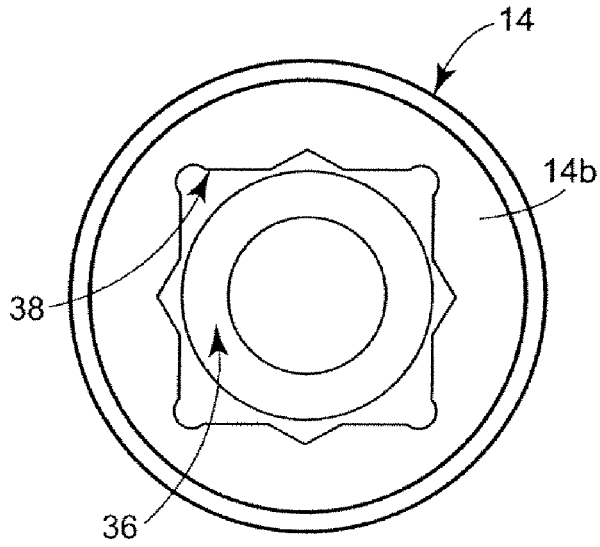
FIG. 3 is an end view of the wedge barrel of FIG. 1.
Figure 4:
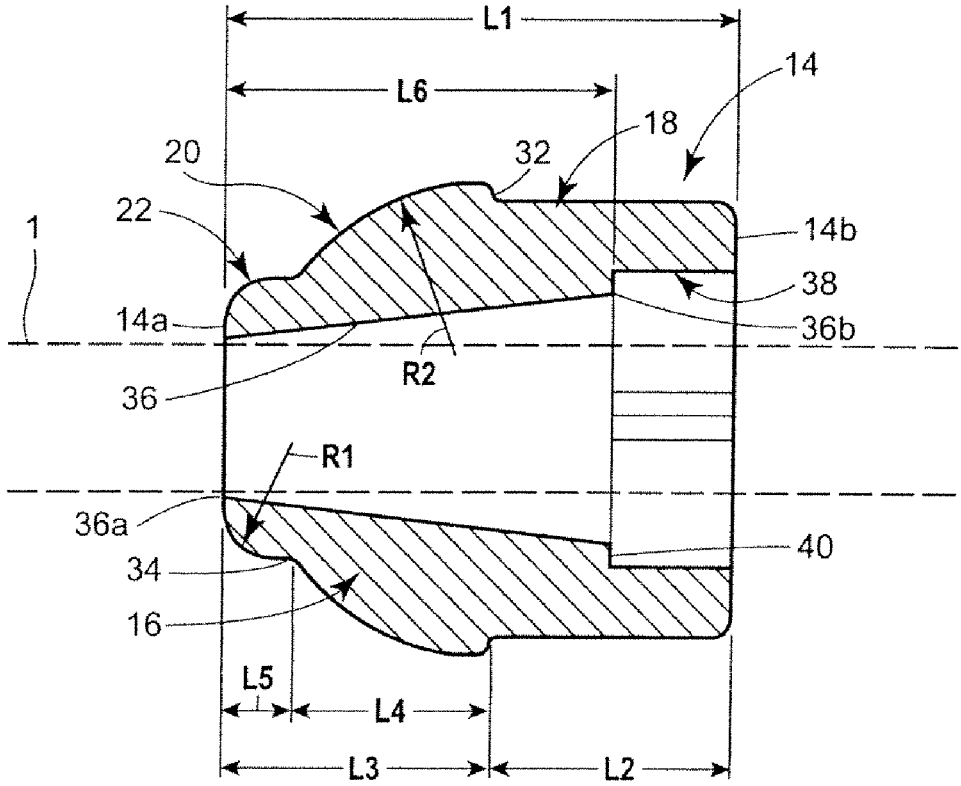
FIG. 4 is a cross-sectional side view of the wedge barrel of FIG. 1.

Finally, as is illustrated in FIGS. 2-4, the barrel 14 of the presently disclosed embodiment of the roof support device 10 further includes a bore 36 and a recess 38. The bore 36 comprises a tapered bore that diverges from the first end 14*a* of the barrel 14 toward the second end 14*b* of the barrel 14. More specifically, the bore 36 includes a first end 36*a* and a second end 36*b*. The first end 36*a* is disposed at the first end 14*a* of the barrel 14. The second end 36*b* is disposed within the body portion 18 of the barrel 14. So disposed, the bore 36 extends from the first end 14*a* of the barrel 14, completely through the head portion 16 of the barrel 14, and approximately halfway through the body portion 18. As illustrated in FIG. 3, the recess 38 is disposed within the second end 14*b* of the barrel 14 and comprises a square cross-section and a floor 40. The floor 40 is spaced from the second end 14*b* of the barrel 14 such that the recess 38 is adapted to receive a nut (not shown), thereby defining what can be considered an "internal drive" barrel 14. The nut is for accommodating a portion of the tensioning cable suspended from the mine roof as described in commonly owned U.S. Pat. No. 6,881,015 entitled "Wedge Barrel For a Mine Roof Cable Bolt," issued Apr. 19, 2005, the entire contents of which are hereby incorporated herein by reference.

Figure 5:
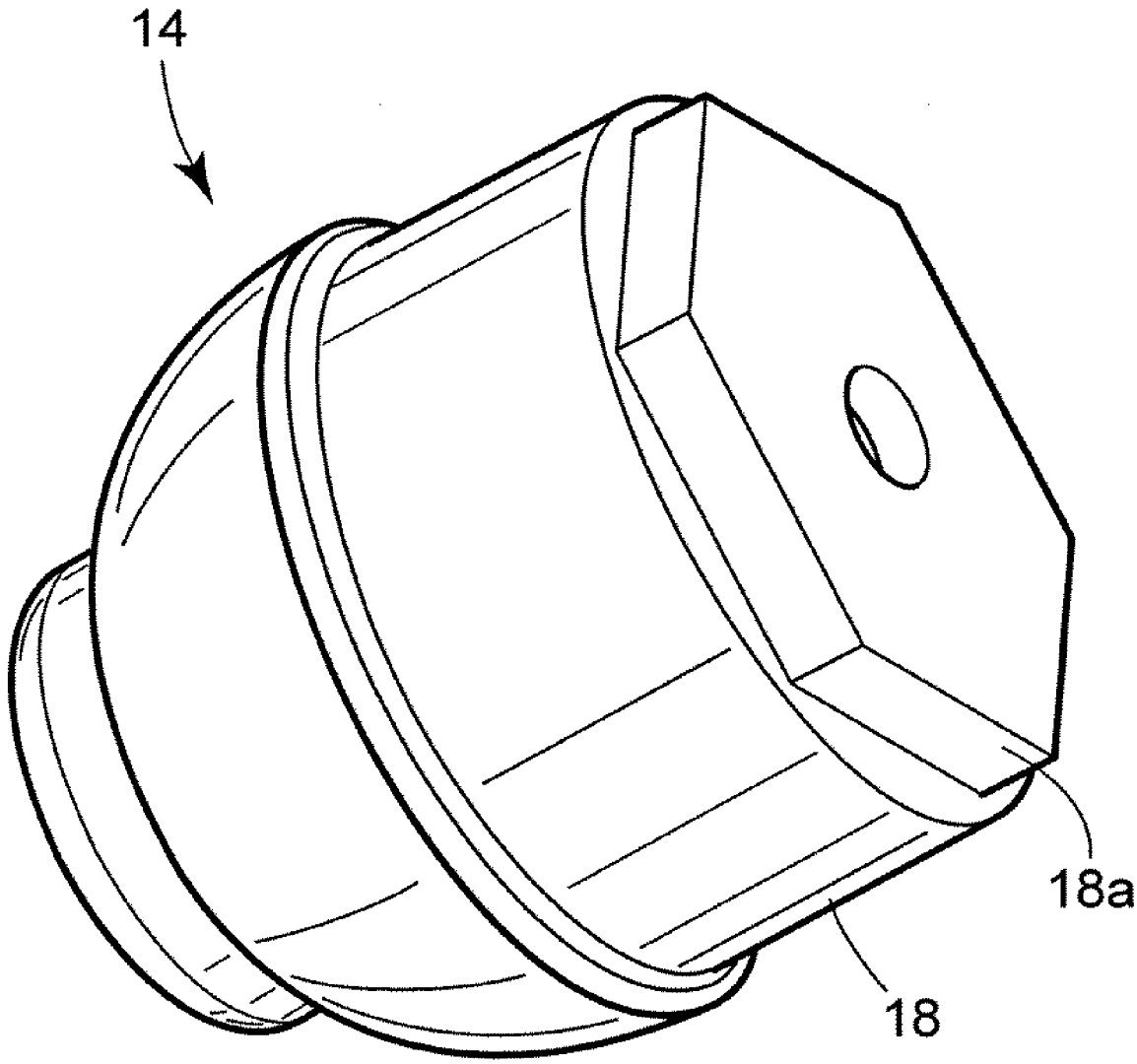
FIG. 5 is a perspective view of an alternative embodiment of a wedge barrel of a mine roof support device constructed in accordance with the principles of the present invention.

While the recess 38 has been described as including a square cross-section, other configurations are intended to be within the scope of the invention. Further, while the barrel 14 has been described as including the recess 38 for receiving a nut, for example, thereby defining an "internal drive" barrel 14, an alternative embodiment of the barrel 14 can comprise an "external drive." For example, one alternative embodiment of the barrel 14 can include the outer surface of the body portion 18 being shaped to accept a drive mechanism, for example. FIG. 5 depicts an embodiment wherein the body portion 18 of the barrel 14 includes a hexagonally-shaped nut 18*a* formed integrally therewith. In a further alternative embodiment, the nut 18*a* can be separate from the body portion 18 of the barrel 14. Therefore, it should be understood that the barrel 14 of the present invention is not limited to internal drive or external drive mechanisms.

Referring back to FIG. 2, during use, the first surface 24 of the roof plate 12 is adapted to be abutted against a mine roof (not shown). A cable 1 (shown schematically in FIG. 4) that suspends from the mine roof is received within the tapered bore 36 of the barrel 14 and secured thereto with the wedges 37 in a known manner. The tension loaded on the cable 1 seats the barrel 14 against the roof plate 12. As mentioned, the convex external surface 20*a* of the shoulder 20 of the barrel 14 seats against the seating surface 30 of the roof plate 12. More specifically, because the seating surface 30 of the presently disclosed embodiment is defined by the interface between the second surface 26 of the roof plate 12 and the through-bore 28, the seating surface comprises a circular edge of the roof plate 12. So configured, the convex external surface 20a of the shoulder 20 of the barrel 14 is in line contact with the seating surface 30. During installation, the curvature of the external surface 20*a* can advantageously assist in aligning the barrel 14 relative to the roof plate 12 even when the mine roof, for example, is not very flat. Moreover, the line contact between the shoulder 20 of the barrel 14 and the seating surface 30 of the roof plate 12 minimizes friction therebetween, which can also assist in aligning the barrel 14 relative to the roof plate 12 during installation by enabling the barrel 14 to easily pivot relative to the roof pate 12 if required.

Still referring to FIG. 2, with the barrel 14 installed, a portion of the head 16 of the presently disclosed embodiment extends completely through the through-bore 28 such that it intersects both the first and second surfaces 24, 26 of the roof plate 12. More specifically, the shoulder 20 of the head portion 16 of the barrel 14 intersects the second surface 26 of the roof plate 12, thereby also intersecting the second plane P2, such that the terminal end 34 of the shoulder 20 is disposed inside of the through-bore 28. The nose 22 of the head portion 16 extends from a location that is inside of the through-bore 28 to a location that is beyond the first surface 24 and outside of the roof plate 12. Thus, the nose 22 intersects the first surface 24 of the roof plate 12, thereby also intersecting the first plane P1. Further, because the tapered bore 36 defined within the barrel 14 extends from the first end 14*a* of the barrel 14 toward the second end 14*b* of the barrel 14, the tapered bore 36 also intersects the first and second surfaces 24, 26 of the roof plate 12, and therefore the first and second planes P1, P2. Therefore, it can be said that both the barrel 14 and the bore 36 of the disclosed embodiment of the roof support device 10 completely intersect the roof plate 12.

In an alternative embodiment, the nose 22 and tapered bore 36, however, may not intersect the first surface 24 of the roof plate 12 and the first plane P1, but rather, can terminate co-planar with the first surface 24 and the first plane P1, or can terminate inside of the through-bore 28 between the first and second surfaces 24, 26 and first and second planes P1, P2.

Referring now to FIG. 4, the barrel 14 of the disclosed embodiment of the present invention includes an overall length L1. The length L1 constitutes the sum of the body portion 18, which has a length L2, and the head portion 16, which has a length L3. The length L3 of the head portion 16 constitutes the sum of the shoulder 20, which has a length L4, and the nose 22, which has a length L5. Moreover, the bore 36 extending through the barrel 14 includes a length L6, which is less than the overall length L1 of the barrel 14 and greater than the length L3 of the head portion 16.

As illustrated in FIG. 2, the roof plate 12 includes a thickness T, while the nose 22 of the barrel 14 includes a diameter D1. The diameter D1 of the nose 22 is less than a diameter D2 of the through-bore 28 in the roof plate 12 and less than a diameter D3 of the body portion 18 of the barrel 14. So configured, the reduced-diameter nose 22 does not abut the sidewalls of the through-bore 28 should the barrel 14 pivot relative to the plate 12 during installation. This optimizes the range through which the barrel 14 can pivot without sacrificing the working length of the barrel 14, i.e., that portion of the overall length L1 of the barrel 14 that lends to the ability to accommodate wedges 37 sufficiently dimensioned to generate the requisite forces to help maintain the connection between the cable and the barrel 14. Further, the bull-nosed surface 22*b* of the nose 22, which is identified in FIG. 1, further reduces the diameter of that portion of the nose 22 disposed immediately adjacent the first end 14*a* of the barrel 14, thereby further increasing the range through which the barrel 14 is free to pivot during installation.

In a preferred embodiment, the length L1 of the barrel 14 is approximately 2.32" (5.89 cm), the length L2 of the body portion 18 is approximately 1.10" (2.79 cm), the length L3 of the head portion 16 is approximately 1.22" (3.09 cm). Therefore, in a preferred embodiment of the barrel 14, an aspect ratio of the barrel 14 to the body portion 18 can be approximately 2:1, and preferably approximately 2.1:1, an aspect ratio of the barrel 14 to the head portion 16 can be approximately 2:1, and preferably approximately 1.9:1, and an aspect ratio of the head portion 16 to the body portion 18 can be approximately 1:1, and preferably approximately 1.1:1.

Moreover, preferably, the length L4 of the shoulder 20 of the head portion 16 is approximately 0.9" (2.28 cm), the length L5 of the nose 22 of the head portion 16 is approximately 0.32" (0.81 cm). Thus, an aspect ratio of the head portion 16 to the shoulder 20 of the head portion 16 is approximately 1.5:1, and preferably approximately 1.35:1, and an aspect ratio of the head portion 16 to the nose 22 of the head portion 16 is approximately 4:1, and preferably approximately 3.8:1.

Further, the diameter D1 of the nose 22 of a preferred embodiment of the barrel 14 is approximately 1.26" (3.20 cm) and the diameter D2 of the through-bore 28 in the roof plate 12 is approximately 1.55" (3.92 cm). Thus, an aspect ratio of the diameter D2 of the through-bore 28 to the diameter D1 of the nose 22 can be approximately 1.25:1, and preferably approximately 1.23:1.

Therefore, in light of the foregoing, the mine roof support device 10 constructed in accordance with the embodiment disclosed herein provides for a low-profile mine roof support 10 that can be installed adjacent an underground mine roof with minimal intrusion into the working space of the mine, and without having to cut a recess in the mine roof.

For example, one advantage provided by the disclosed embodiment of the mine roof support device 10 is that it extends a shorter distance below the mine roof and into the mine than a conventional mine roof support device. Conventional mine roof support devices can extend in the range of approximately 2.2" (5.5 cm) to approximately 2.6" (6.6 cm) below the mine roof. To the contrary, because the disclosed embodiment of the barrel 14 includes a head portion 16 that at least extends into, and in one embodiment completely through, the roof plate 12, the support device 10 can merely extend approximately 0.98" (2.5 cm) below the mine roof.

In addition, by including a head portion 16 that has a shoulder 20 and nose 22 as described herein. The present invention reduces the amount which the barrel 14 extends into the working space of the mine without substantially sacrificing the working length of the barrel 14. For example, conventional barrels can have a total barrel length of approximately 2.7" (6.92 cm), while the disclosed embodiment of the barrel 14 includes an overall length L1 of approximately 2.32" (5.889 cm). Thus, the barrel 14 is long enough to define an internal bore 36 that is sufficiently long to receive conventional wedges 37 and generate sufficient force to secure a cable therein while minimizing mine intrusion.

Moreover, as described, the line contact between the convex external surface 20*a* of the shoulder 20 and the seating surface 30 provide for reduced friction to enable the barrel 14 to easily align itself during installation. However, alternative embodiments of the seating surface 30 can include geometries other than the circular edge between the through-bore 28 and the second surface 26 of the plate 12. For example, the seating surface 30 can include a frustoconical surface, which would provide a surface contact between the barrel 14 and the roof plate 12. Another alternative seating surface 30 could include a rounded surface, which would also provide a line contact. Therefore, the seating surface 30 is not limited to that which is described herein.

Finally, the reduced diameter of the nose 22 optimizes the range through which the barrel 14 can pivot to accommodate changes in the orientation of the roof plate 12 due to uneven mine roof surfaces, for example. It should also be understood that in alternative embodiments, the diameter D2 of the through-bore 28 in the roof plate 12 can also be increased to increase the range through which the barrel 14 can freely pivot due to uneven mine roof surfaces.

Figure 6:
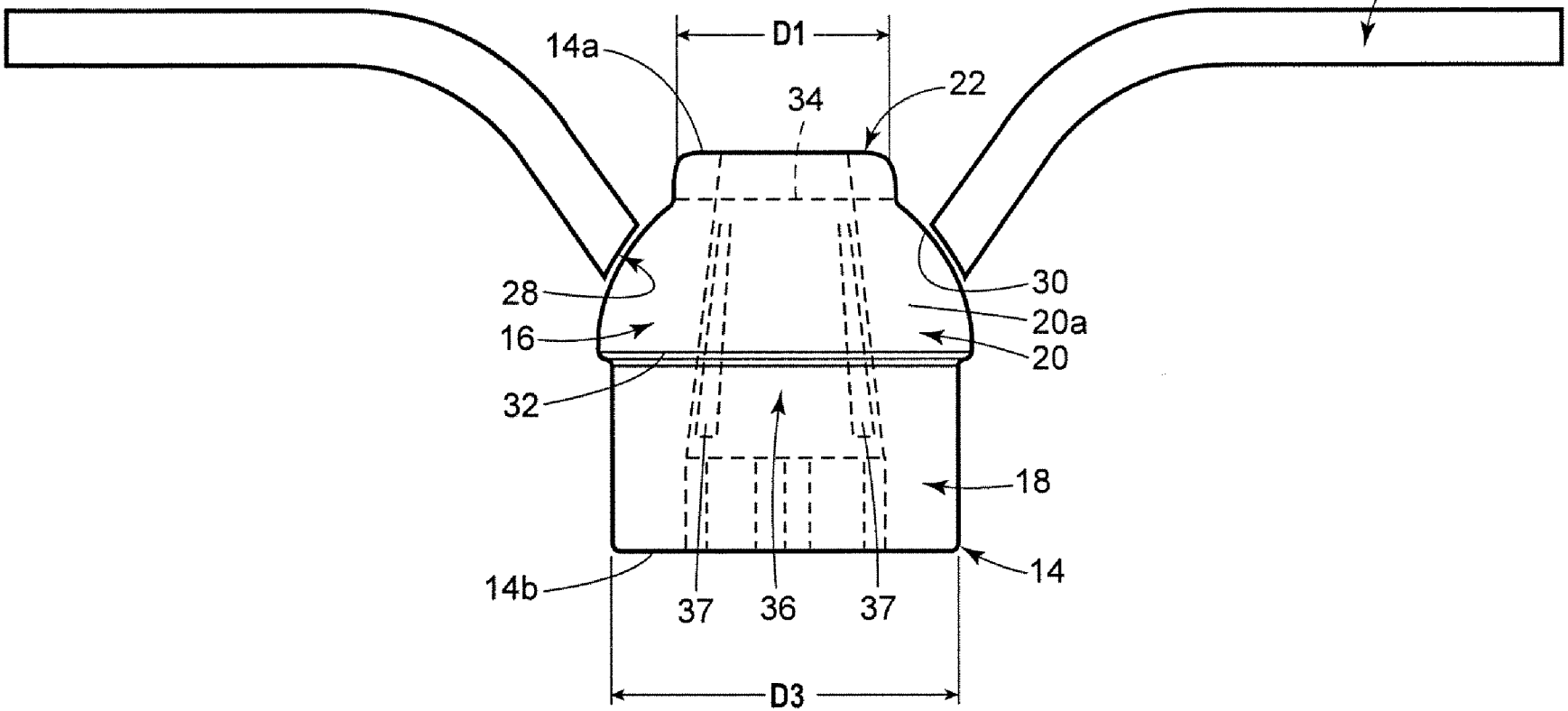
FIG. 6 is a side view of another alternative embodiment of a mine roof support device constructed in accordance with the principles of the present invention including the wedge barrel of FIG. 1 and an alternative roof plate.

While the roof plate 12 has been disclosed herein as comprising first and second surfaces 24, 26 disposed in parallel planes P1, P2, respectively, in the region surrounding the through-bore 28, an alternative embodiment of the roof plate 12 can include first and second surface 24, 26 completely disposed within the respective first and second planes P1, P2. Moreover, in a further alternative embodiment, the roof plate 12 can include a curved roof plate such as that depicted in FIG. 6 and disclosed in commonly owned U.S. Pat. No. 6,881,015, entitled "Wedge Barrel For Mine Roof Cable Bolt," the entire contents of which are hereby incorporated herein by reference in their entirety. While the roof plate 12 depicted in FIG. 6 is illustrated as providing surface contact with the shoulder 20 of the head portion 16 of the barrel 14, an alternative embodiment of the through-bore 28 in the roof plate 12 can be altered to provide a line of contact similar to that which was described above with reference to the embodiments depicted in FIGS. 1-5.

It will be appreciated that details of the various embodiments discussed herein are not intended to be mutually exclusive. Thus, various aspects and details of the disclosed examples can be interchanged.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed:

1. A low-profile mine roof support device, comprising:

a plate comprising a bore, a first surface portion immediately surrounding the bore, a second surface portion immediately surrounding the bore, and a seating surface disposed between the second surface portion and the bore, the first surface portion entirely disposed within a first plane, the second surface portion entirely disposed within a second plane that is parallel to the first plane, the first surface portion adapted to be abutted against a mine roof;

a barrel comprising a first end and a second end;

a tapered bore extending from the first end of the barrel toward the second end of the barrel for receiving a cable;

at least one wedge adapted to be received within the tapered bore of the barrel to anchor the cable to the barrel;

a cylindrical body disposed at the second end of the barrel; and a head disposed at the first end of the barrel, the head comprising a shoulder portion that is spaced from the first end of the barrel, the shoulder portion having a convex external surface in contact with the seating surface of the plate such that a portion of the head extends from the second surface portion of the plate, completely through the bore, and beyond the first surface portion of the plate.

2. The device of claim 1, wherein the convex external surface of the shoulder portion of the head comprises a beginning end disposed adjacent to the body of the barrel, and a terminal end disposed away from the body of the barrel and between the first and second ends of the barrel, the terminal end having a diameter that is smaller than a diameter of the beginning end.

3. The device of claim 2, wherein the head of the barrel further comprises a nose portion extending from the terminal end of the convex surface of the shoulder portion.

4. The device of claim 3, wherein the nose portion comprises a right circular cylinder.

5. The device of claim 4, wherein a diameter of the nose portion is smaller than a diameter of the bore in the plate such that the barrel can pivot relative to the plate.

6. The device of claim 1, wherein the convex surface of the shoulder portion of the head comprises a partial spherical surface.

7. The device of claim 1, wherein the tapered bore of the barrel intersects the first and second planes.

8. The device of claim 1, wherein the convex surface of the shoulder portion of the head of the barrel is in line contact with the seating surface of the plate.

9. A low-profile mine roof support device, comprising:

a plate comprising a bore, a first surface portion immediately surrounding the bore, a second surface portion immediately surrounding the bore, and a seating surface disposed between the second surface portion and the bore, the entire first surface portion of the plate being disposed within a first plane and adapted to at least partially abut a mine roof, the entire second surface portion being disposed within a second plane that is parallel to the first plane;

a barrel comprising a body portion, a nose portion, and a shoulder portion disposed between the body portion and the nose portion, the barrel defining a tapered bore for receiving a cable that penetrates a bore in the mine roof;

at least one wedge adapted to be received within the tapered bore of the barrel to anchor the cable to the barrel, wherein the shoulder portion of the barrel comprises a convex external surface adapted to be in contact with the seating surface of the plate such that a portion of the shoulder portion is disposed within the cylindrical bore of the plate and extends from the second surface portion of the plate toward the first surface portion of the flat plate, and the nose portion of the barrel comprises a cylindrical external surface that has a diameter that is smaller than the maximum diameter of the shoulder portion, the nose portion extends from the shoulder portion such that at least a portion of the nose portion is disposed within the cylindrical bore of the plate when the convex external surface of the shoulder portion is in contact with the seating surface.

10. The device of claim 9, wherein the nose portion of the barrel intersects the first plane, in which the entire first surface of the plate is disposed.

11. The device of claim 9, wherein the cylindrical external surface of the nose portion of the barrel comprises a right circular cylinder.

12. The device of claim 9, wherein a diameter of the nose portion is smaller than a diameter of the bore in the plate such that the barrel can pivot relative to the plate.

13. The device of claim 9, wherein the convex surface of the shoulder portion comprises a partial spherical surface.

14. The device of claim 9, wherein the seating surface of the plate comprises circular edge defined at the interface between the cylindrical bore and the second surface, the circular edge adapted for line contact with the convex external surface of the shoulder portion of the barrel.

15. The device of claim 9, wherein the tapered bore of the barrel intersects the second plane, in which the entire second surface of the plate is disposed, when the shoulder portion of the barrel is in contact with the seating surface of the plate.

16. The device of claim 9, wherein the tapered bore of the barrel intersects the first plane, in which the entire first surface of the plate is disposed, when the shoulder portion of the barrel is in contact with the seating surface of the plate.

17. A low-profile mine roof support device, comprising:

a plate comprising a bore, a first surface portion immediately surrounding the bore, a second surface portion immediately surrounding the bore, and a seating surface disposed between the second surface portion and the bore, the entire first surface portion being disposed within a first plane, the entire second surface portion being disposed within a second plane that is parallel to the first plane, the first surface portion adapted to be abutted against a mine roof;

a barrel comprising a first end, a second end, and a convex shoulder portion disposed between the first end and the second end, the convex shoulder portion in contact the seating surface of the plate;

a tapered bore defined by the barrel for receiving a cable, the tapered bore diverging from the first end of the barrel toward the second end of the barrel such that the tapered bore extends completely through the bore in the plate and beyond the first and second surface portions; and at least one wedge adapted to be received within the tapered bore of the barrel to anchor the cable to the barrel.

18. The device of claim 17, wherein the barrel further comprises a nose portion extending from the convex shoulder portion and intersecting the first plane.

19. The device of claim 18, wherein the nose portion comprises a right circular cylinder having a diameter that is smaller than the maximum diameter of the convex shoulder portion.

20. The device of claim 18, wherein a diameter of the nose portion is smaller than a diameter of the bore in the plate such that the barrel can pivot relative to the plate.

21. The device of claim 17, wherein the convex shoulder portion of the barrel comprises a partial spherical surface.

22. The device of claim 17, wherein the convex shoulder portion of the barrel is in line contact with the seating surface of the plate.

23. A low-profile mine roof barrel for use with a mine roof support device that includes an entirely flat roof plate in abutment with the mine roof and a cable a suspended from the mine roof, the roof plate defines a cylindrical bore through which the cable passes to be connected to the barrel, the barrel comprising:

a first end and a second end;

a first cylindrical portion disposed at the second end and having a first diameter;

a tapered bore extending from the first end toward the second end, the tapered bore for receiving the cable and adapted to receive at least one wedge for anchoring the cable to the barrel;

a partial spherical portion spaced from the first end of the barrel and including a continuous convex profile having a beginning end disposed adjacent the first cylindrical portion and a terminal end spaced away from the first cylindrical portion, the partial spherical portion adapted to engage the roof plate such that at least a portion of the partial cylindrical portion is disposed within the cylindrical bore of the roof plate; and a second cylindrical portion disposed at the first end of the barrel and having a second diameter that is smaller than the first diameter of the first cylindrical portion, the second cylindrical portion adapted to extend beyond the roof plate when the partial spherical portion engages the roof plate.

24. The device of claim 23, wherein the second cylindrical portion comprises a right circular cylinder.

* * * * *